US005191922A

United States Patent [19]

Wade

[11] Patent Number: 5,191,922

[45] Date of Patent: Mar. 9, 1993

[54] TWO-ON-ONE SNAP, SELF INSTALLING AND SUPPORTING CURTAIN AND VALANCE ASSEMBLY

[76] Inventor: Debra A. Wade, 4204 Palm Dr., Knoxville, Tenn. 37914

[21] Appl. No.: 832,737

[22] Filed: Feb. 7, 1992

[51] Int. Cl.[5] ..... A47H 1/00

[52] U.S. Cl. ..... 160/124; 160/38; 160/330

[58] Field of Search ..... 160/124, 123, 125, 126, 160/38, 39, 330, DIG. 6, 108

[56] References Cited

U.S. PATENT DOCUMENTS

| | | | |
|---|---|---|---|
| 1,778,499 | 10/1930 | King | 160/330 |
| 2,200,041 | 5/1940 | Rosenberg | 160/126 |
| 2,500,074 | 3/1950 | Hill | 160/330 X |
| 2,587,492 | 2/1952 | Lipetz | 160/124 |
| 2,600,152 | 6/1952 | Blatt | 160/124 |
| 2,840,155 | 6/1958 | Stern | 160/124 |
| 3,115,181 | 12/1963 | Snyder | 160/330 X |
| 3,321,003 | 5/1967 | Boerner | 160/330 X |
| 3,422,879 | 1/1969 | Ryan . | |
| 3,437,127 | 4/1969 | Lukashok . | |
| 3,616,486 | 11/1971 | Ford et al. . | |
| 3,681,158 | 8/1972 | F0ggo . | |
| 3,688,341 | 9/1972 | Peckham . | |
| 3,785,003 | 1/1974 | Thomson . | |
| 3,905,414 | 9/1975 | Guebert et al. . | |
| 4,217,676 | 8/1980 | Terrones . | |
| 4,237,958 | 12/1980 | Guebert et al. . | |
| 4,466,476 | 8/1984 | Fairbanks . | |
| 4,550,038 | 10/1985 | Becker et al. . | |

*Primary Examiner*—David M. Purol
*Attorney, Agent, or Firm*—Monroe Alex Brown

[57] ABSTRACT

A self-supporting curtain and valance assembly for direct mounting onto a single curtain rod or shower-bath support, installed in juxtaposition with a window, door, shower-bath area or the like, is disclosed. The assembly (10) includes a curtain subassembly (20), functional in various configurations. The curtain (20) has a number of first coupling subunits (30) secured to the inside surface (26) of the flap of the curtain. The flap has a number of second coupling subunits (32) secured to its inside surface. The flap can be engaged and looped around a curtain rod or support and attached to itself by the first and second coupling subunits for self-supporting the curtain subassembly on the rod without the need for separate, independently added hooks or the like. The curtain has a plurality of third coupling subunits (36) fixed to the outside surface (28) of the flap. The assembly further includes a valance subassembly (40) having a number of fourth coupling subunits (50) attached to its inside surface (46), allowing the valance to be optionally attached to the curtain by coupling the fourth subunits of the valance with the third subunits of the curtain for self-support of curtain and valance on a single curtain support. The curtain has a porous trim section (56) through which the third and fourth subunits couple; and a shear subassembly (60) mounted over the curtain rod and pressed and molded between the first and second curtain subunits to support the shear within the curtain.

6 Claims, 9 Drawing Sheets

TWO-ON-ONE SNAP, SELF INSTALLING AND SUPPORTING CURTAIN AND VALANCE ASSEMBLY

BACKGROUND OF THE INVENTION

1. Field of the Invention

This invention relates to an improved device for hanging and supporting drapes or curtains and valence portions on single conventional curtain rod assemblies.

2. Background Information

Various types of curtains or drapery, drapery systems and drapery connection and hanging assemblies have been known in the art. Typical of these inventions are U.S. Pat. Nos. 4,550,038; 4,466,476; 4,237,958; 4,217,676; 3,905,414; 3,785,003; 3,688,341; 3,681,158; 3,616,486; 3,437,127 and 3,422,879; which were located during the process of a patent search. Copies of all patents cited are enclosed pursuant to 37 CFR §§1.97–1.99.

Some of the prior art references include the concept of having certain portions of drapes or curtains connected or attached by snap means to a drapery connector assembly or means for supporting drapes or curtains. Examples of this type of art include U.S. Pat. Nos. 4,237,958; 3,905,414 and 3,688,341; issued respectively to Guebert et al., Guebert et al. and Peckham.

The two Guebert references disclose a drapery connector assembly and improved drapery connector assembly. The '958 Guebert Patent reference discloses a connector assembly utilized to drape a table or stage having a peripheral edge with a downwardly extending flange, as illustrated in FIGS. 2, 3, 4 and 6 of its drawings. This connector assembly discloses and claims a plurality of improved clips which are adapted to be clamped along the peripheral edge of the table or stage. A section of each clip is provided with a fastener to receive a mating fastener from a drapery section such that the drapery is suspended by the installed clips. The '414 Guebert reference discloses a similar assembly arrangement with each of the clips having a different structural design from the later improved '958 Guebert Patent reference. Neither of the Guebert references disclose a means whereby the drapery or curtain means itself is provided with a means of being self-supporting together with the ability to receive additional attachable valance portions. Guebert teaches support of a drapery section by utilizing a plurality of installed clips rather than self-support of the drapery itself while installed on a traditional curtain rod.

The '341 Peckham patent reference teaches a slidable snap fastener device for supporting drapes or curtains. Peckham discloses a slide member which is mounted in a slotted track or transverse rod. The slide member is provided with an arm portion carrying a U-shaped hook member. One part of a snap fastener is secured to one leg of the hook member in the Peckham device, and the other part is adapted to be secured to a drape or curtain. This invention requires and claims a slotted horizontally disposed track where a slide member having a hook receiving opening is adapted to slide on the track; a U-shaped hook having a pair of depending legs to be mounted on the slide member; one portion of a two part snap fastener to be mounted on one of the hook's legs; and the other portion of the snap to be secured to the drapery and attached in cooperation so that the drapery is supported by the slide member and U-shaped hook on the track. The Peckham device does not disclose or claim a self-supporting drapery device which may function in the absence of sliding members, hooks or specially designed track means.

Additionally in the prior art a number of inventions have employed various hook, clamp and drape pin means to secure curtain and drapery sections onto transverse hanging rods, resulting in a number of disadvantages which exist the art presently. Examples of such art include U.S. Pat. Nos. 3,681,158; 3,437,127 and 3,422,879; issued respectively, to Foggo, Lukashok and Ryan.

None of the references specifically illustrates the present invention. Nor is the present invention obvious in view of any of the prior art references listed herein. In addition, all of the prior art heretofore known suffer from a number of disadvantages:

(a) The prior art devices require additional hooks, hanging members, tracking systems or specially designed hanging rod systems in order to support sections of curtain or drapery above an installation area.

(b) The prior art devices are not designed or adapted to add or change the valance without the need for taking the installed curtain down to carefully fix individual, independent members to the curtain in what has resulted in a time consuming process. Therefore, the valance on an installed prior art curtain can not be easily changed to introduce different design arrangements in a room or near an installation area such as floral, stripe or solid color changes, to enhance room decoration.

(c) The prior art devices are not designed to be effectively utilized with or without a valance.

(d) It is a further disadvantage of the prior art curtain and drapery devices that they are not self-supporting, but require additional detachable members such as clips, hooks or other independent parts in order to be properly supported and installed.

(e) Additionally, the prior art devices often require one, two or three additional hanging rods or more intricate, complicated and expensive hanging devices in order to install curtains together with valance or shear sections.

(f) It is yet a further disadvantage of the prior art devices that they are not easily mounted, supported or installed on single conventional curtain rods.

(g) Additionally, the prior art devices are not designed or adapted to install a curtain and valance as one self-supporting unit or assembly on a single curtain rod.

These and other disadvantages of the prior art will become apparent in reviewing the remainder of the present specification and the drawings.

Accordingly, it is an object of the present invention to provide a self-supporting and self-installing curtain and valance assembly which does not require additional hooks, clips or other independent securing members for installation and support.

It is a further object of the invention to provide an assembly which easily allows for the change and installation of different valance subassemblies to easily and quickly change curtain design and enhance room decoration.

It is yet a further object of the present invention to provide an assembly which can be used with or without a valance subassembly, and which is provided with a mesh trim surfaced portion which enhances the visual appearance of the curtain subassembly without adversely affecting the connection over the mesh surface of a selected valance subassembly.

An additional object of the present invention is to provide a two-on-one snap, self-supporting curtain and valance assembly which can be easily mounted and installed together on a simple, single conventional or inexpensive curtain rod by providing self-contained, coupling support by wrapping around a single, conventional curtain rod and snapping or coupling together for self-support by the curtain's own closed surface thereon.

Additional object of the present invention include providing a self-supporting curtain and valance assembly which makes hanging curtains and drapes easy and simple, and which provides a two-on-one snap curtain that eliminates the old fashioned problems associated in the prior art with hanging and installing curtains.

SUMMARY OF THE INVENTION

The foregoing and other objects can be achieved with the present invention assembly which is a two-on-one self-installing and self-supporting curtain and valance assembly which includes several novel subassemblies which work in relation to one another and in combination with their use with a conventional, transverse curtain or drapery rod installed over a window, door or the like. The curtain and valance assembly is provided with a curtain subassembly having flap and bottom end portions. This subassembly is provided on one surface with a number of first coupling subunits along a common plane proximate to the outer edge of its flap portion and a number of second coupling subunits on the same surface of the flap along a further common plane which is a distance from the first coupling subunits and parallel to these coupling subunits. In attaching the coupling subunits as indicated, the flap portion of the curtain subassembly can be looped and engaged around a transverse curtain rod, and the first coupling subunit members can be attached to the second coupling subunits for self-supporting the curtain subassembly on the curtain rod.

The curtain subassembly is also provided with a number of third, additional coupling subunits on the flap portion surface opposite the attachment of the first and second coupling subunits along a common plane which is parallel to each of the axis lines or planes established by the first and second coupling subunits on the other, opposite surface and facing in a direction away from the installation area when the curtain subassembly is installed in self-supporting position.

The curtain and valance subassembly is also provided with a valance subassembly having its own coupling subunit members securely attached to one surface of the top section of the valance subassembly along its own common plane line positioned in relationship to the other common plane portions. The valance subassembly is adapted so that its coupling members can be attached to the third coupling subunits of the curtain subassembly and installed substantially parallel to the transverse curtain rod over an installation area as indicated.

REFERENCE NUMERALS IN DRAWINGS

Figure 1A:
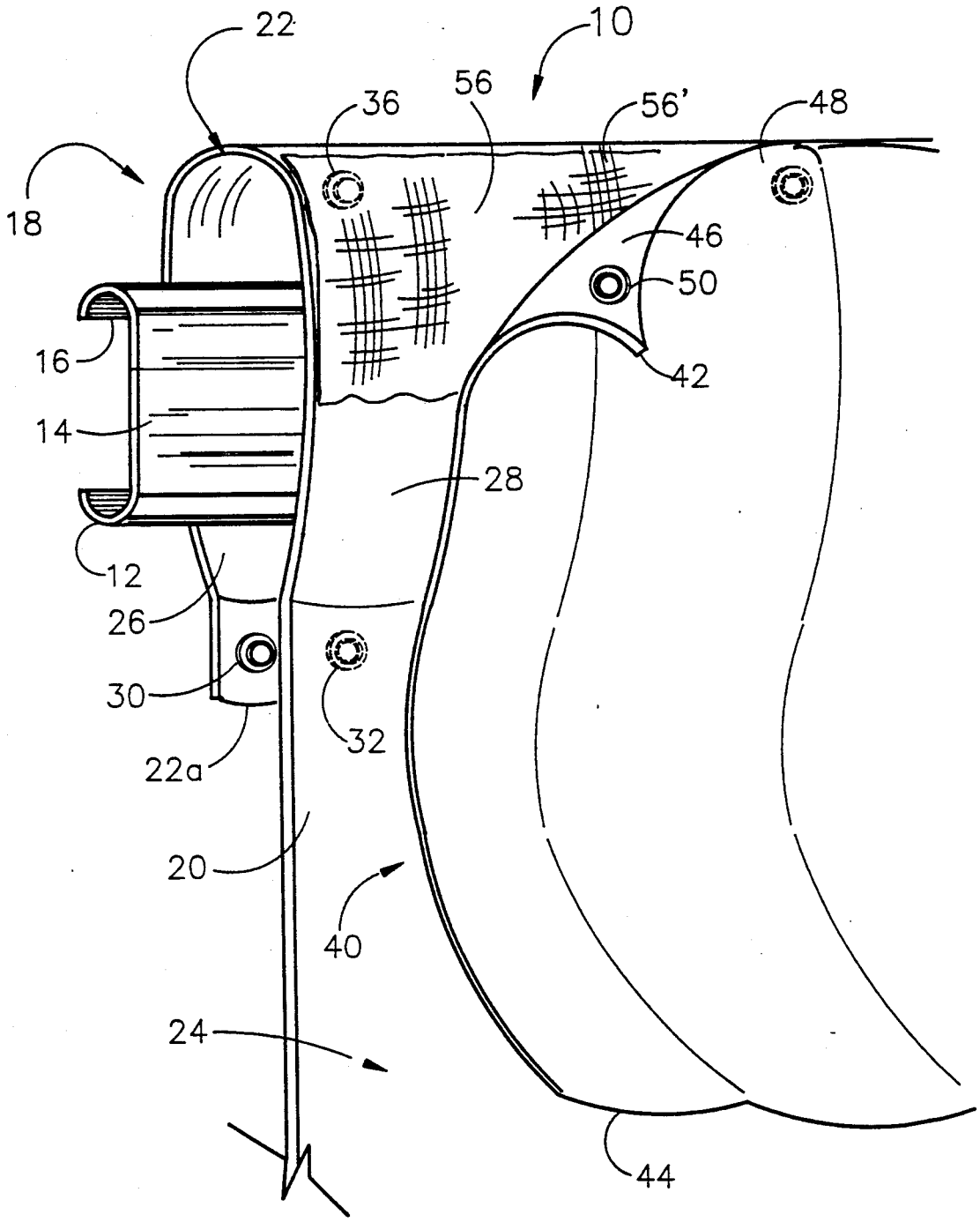
FIG. 1A is a perspective view of a preferred embodiment of the novel two-on-one snap, self-supporting curtain and valance assembly of the present invention mounted on a conventional curtain rod, also containing a snap-away portion of the valance subassembly and mesh surface of the present invention.

| | | | |
|---|---|---|---|
| 10 | self-installing and supporting curtain and valance assembly | 12 | curtain and drapery rod |
| 14 | front surface of (12) | 16 | back surface of (12) |
| 18 | installation area | 20 | curtain subassembly |
| 22 | flap sectional portion of (20) | 22a | terminal boundary of flap (22) |
| 22' | first common plane portion | 23 | second common plane |
| 24 | bottom sectional portion of (20) | 26 | inside surface area (20) |
| 28 | outside surface area (20) | 30 | first snap-coupling member on (22) |
| 32 | second snap-coupling members on (22) | 34 | continuous loop of (20) |
| 36 | third snap-coupling members (22) | 38 | third common plane portion (22) |
| 40 | valance subassembly | 42 | top section of (40) |
| 44 | bottom section of (40) | 46 | inside surface area (40) |
| 48 | outside surface area of (40) | 50 | fourth snap-coupling members |
| 52 | fourth common plane portion | 54 | positional phantom lines (36, 50) |
| 56 | mesh surface trim member (10, 20) | 56' | open spaces-pores |
| 60 | shear subassembly | 62 | looped flap section (60) |
| 64 | tail section (60) | 66 | first snap-coupling subunits (60) |
| 68 | top edge of shear (60) | 70 | first straight common axis (66) |
| 72 | second snap coupling subunits (60) | 74 | second straight common axis (60) |
| 76 | looping motion, drawing first to second snaps | 78 | open mesh spaces (60) |
| 80 | one-piece setup of assembly (10) | 32' | second snap-coupling member being available for attachment through shear (60) |
| 20' | left side curtain | 20" | right side curtain |

-continued

| REFERENCE NUMERALS IN DRAWINGS | | | |
|---|---|---|---|
| | assembly (20)-two part set up | | assembly (20)-two part setup |
| 60' | shear subassembly constructed from soft, flexible, pressable material substance or substances | 82 | two part setup of assembly (10) |

DETAILED DESCRIPTION OF THE PREFERRED EMBODIMENTS OF THE INVENTION

The following description of the preferred embodiments of the concepts of this invention is made in reference to the accompanying figures. Where an individual structural element is depicted in more than one figure, it is assigned a common reference numeral, numeral and prime mark or numeral and small letter for simplification of identification and understanding.

Figure 1B:
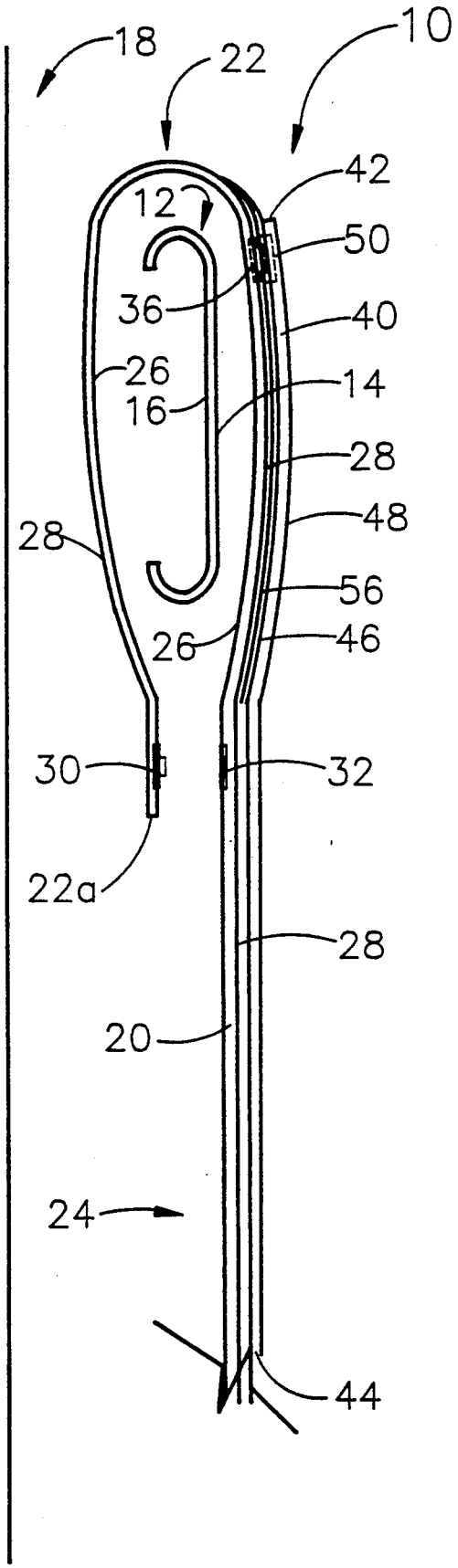
FIG. 1B is a side view of a preferred embodiment of the present invention.
Figure 2:
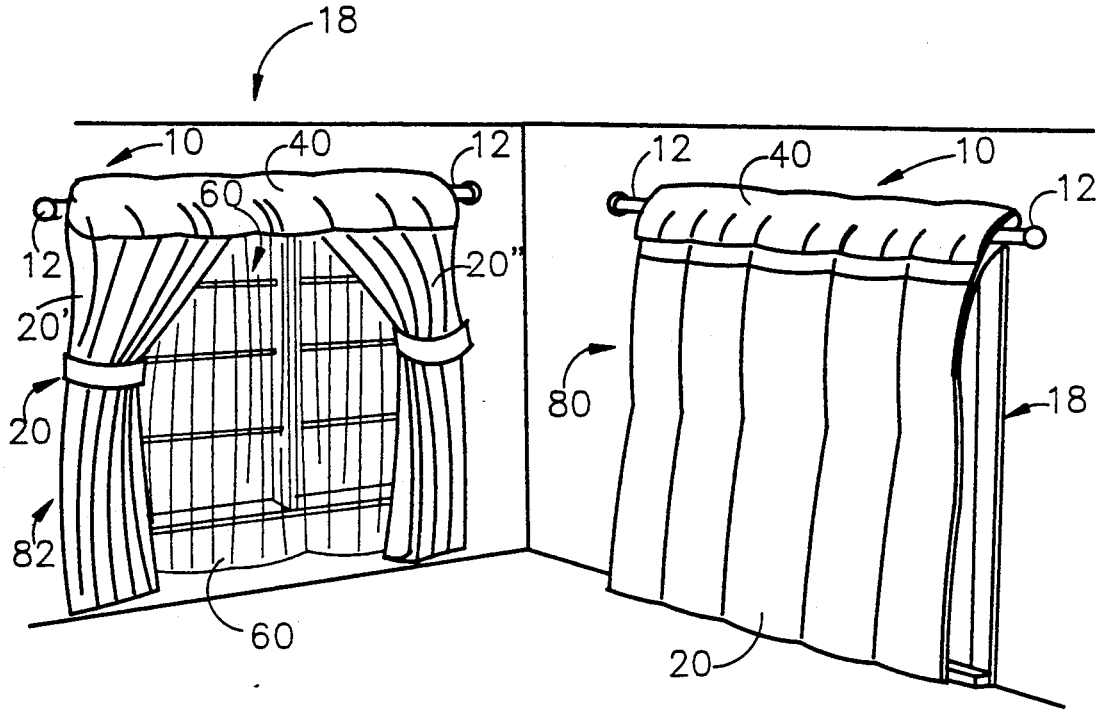
FIG. 2 is a perspective view of a room illustrating preferred embodiments of the present invention installed over window and sliding door installation areas respectively.

Referring now to the drawings, and more particularly to FIGS. 1A, 1B and 2, thereof, there is shown a self-installing and self-supporting curtain and valance assembly 10, also referred to as a two-on-one snap, self-installing and self-supporting curtain and valance assembly, which is constructed in accordance with the present invention; and which, as shown, is adapted to be used in attached or installed combination with a conventional transverse curtain or drapery hanging rod 12. It will be understood that a large number of curtain, drapery and other types of curtain or other embellishment, hanging support means or apparatus are available on the market, including, but not limited to, various single curtain rods, dauphine rods, crystal clear rods, standard window and door rods, cafe rods, country curtain pole rods and other types of conventional and traditionally available rods. A conventional, telescopically tracked curtain hanging rod is illustrated in FIGS. 1A, 1B , 3–7 and 8. The front surface 14 of the rod 12 is shown facing away from an installation area 18, such as a window, door or the like; and the back surface area 16 of the rod 12 is illustrated facing toward the installation area 18, as is the conventional, positional placement. Many other diverse types of conventional hanging and support systems may be employed in combination with the present invention without the need for additional hooks or other independently installed hanging or securing members.

The self-installing and self-supporting curtain and valance assembly 10, hereinafter referred to as the two-on-one assembly 10, the assembly 10 or the present invention; is provided with a flexible curtain subassembly 20. The curtain 20 can be constructed from a number of flexible fabric material or other flexible, pliant substance or substances, including, but not limited to, antique satin, combinations of fabric including 70% polyester and 30% cotton; 100% polyester; combinations of fabric material including 70% polyester and about 27% to about 30% rayon and about 1% to about 3% cotton; and combinations of fabric material including 35% rayon and 60% coloray acetate with rubber or cotton backing. It will be understood that many other materials can be utilized in constructing the curtain 20.

The curtain 20, as illustrated in FIGS. 1 through 8 and 10, is shown to have a flap sectional portion 22 and a bottom sectional portion 24. The curtain 20, itself, will substantially have the cross-sectional and area dimensions of a rectangular or square figure or pattern, as illustrated by example in FIGS. 2, 3, 4, 5, 6, 7, 8 and 10. It will be understood, however, that many geometric configurations are adaptable, capable of or subject to utilization by the concepts of the present invention.

The flap portion 22 is designed in the present invention's assembly 10 to be utilized as illustrated in FIGS. 1A, 1B , 3, 4–7, 8 and 10; and to be looped, wrapped-around or attached for self-support and installation as indicated herein.

The curtain 20 is also provided, as illustrated, with an inside surface area 26 and an outside surface area 28 which is coterminal with the flap 22 and the bottom 24 of the curtain 20.

Figure 4:
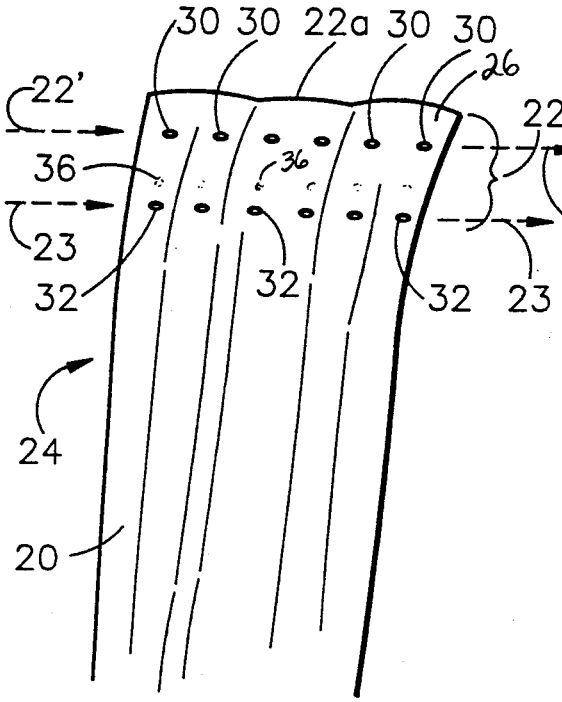
FIGS. 4 and 4A are a substantially flat layout pattern view of the inside surface of the curtain subassembly.
Figure 5:
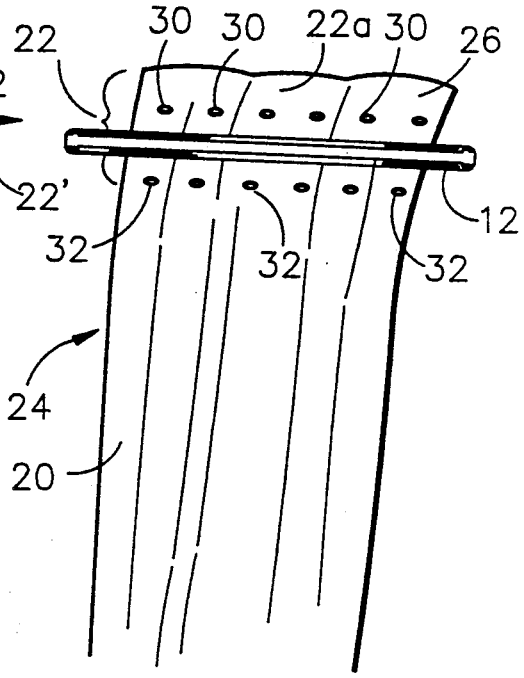
FIG. 5 is a view of the outside surface of the curtain subassembly illustrating placement and positioning in reference to or combination with a conventional curtain rod.
Figure 6:
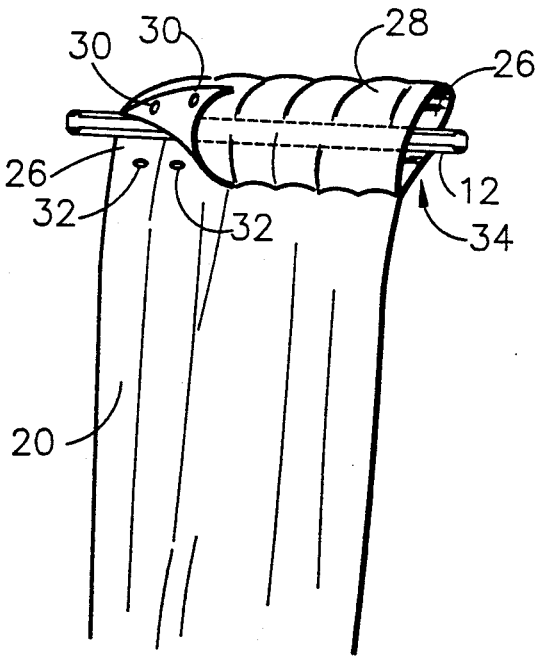
FIG. 6 is a back perspective view of the curtain subassembly of the present invention illustrating placement and snap, self-supporting attachment of the curtain in reference to a conventional curtain rod.
Figure 7:
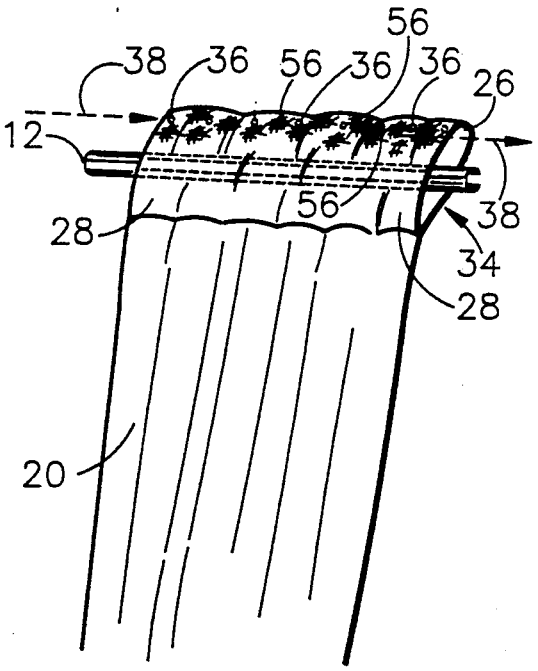
FIG. 7 is a front perspective view of the present invention illustrating the installed, self-supporting curtain subassembly.
Figure 4A:
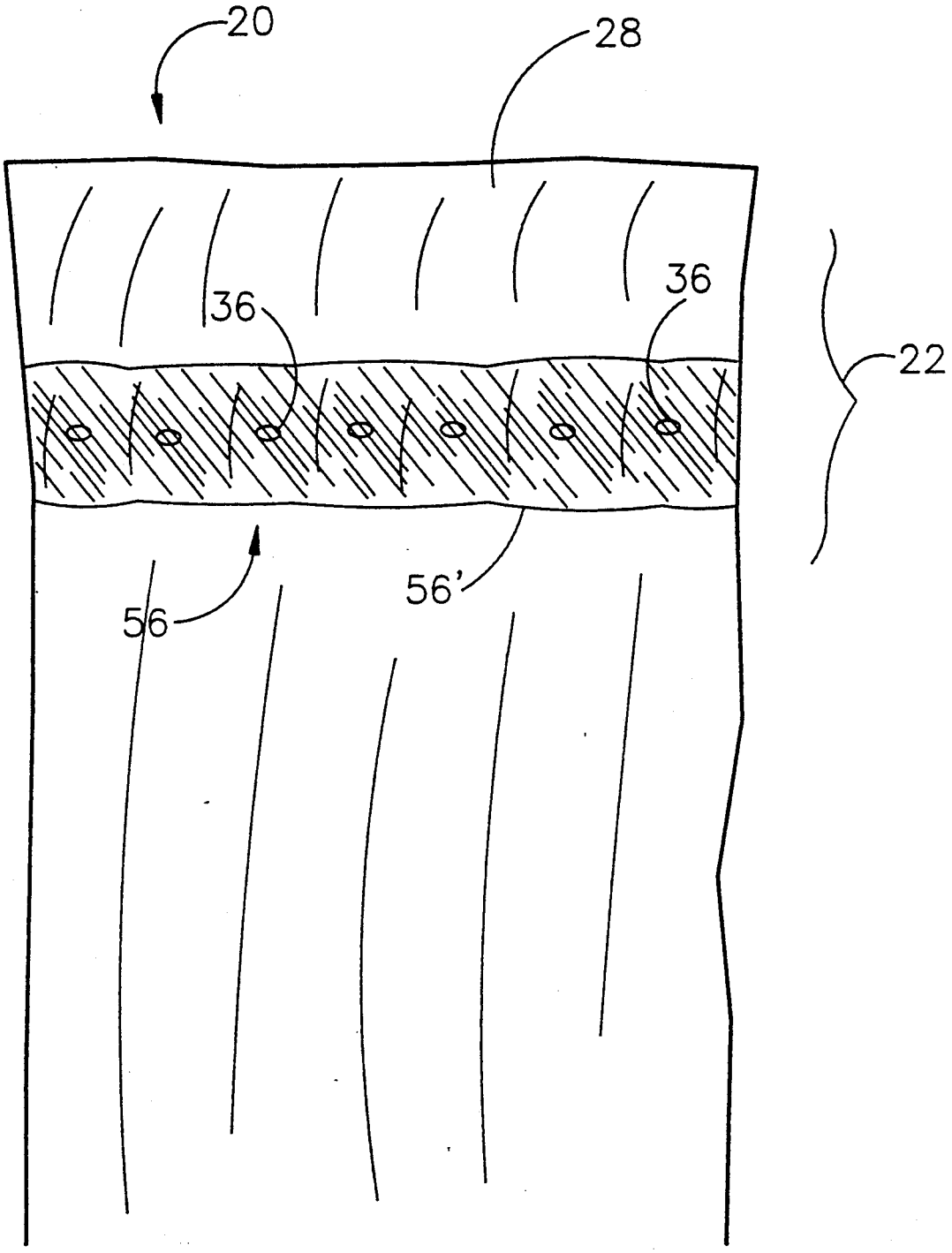

The Two-On-One Assembly 10 further includes as a part of its curtain subassembly 20, a first snap-coupling member 30. A plurality of coupling members 30, a selected number of the members 30 from two to three, four to six, or more, are securely attached to the inside surface 26 of the flap 22 along a common plane 22' positioned substantially flat, or parallel and close to a distal, top or terminal boundary **22*a* of the flap 22 across the transverse length of the curtain 20, as illustrated in FIGS. 4 and 5 and other drawings included with the specification. This first coupling means is, therefore, composed of individual members 30, which can include a plurality or grouping of such members 30** or be designed to augment a one attachment or one position, snap means.

Any of a various arrangement of coupling or securing means may be used to constitute the member 30, including, but not limited to nickle plated brass snaps (sew on or machine stamped type), sizes 1, 2 or 3, with heavier materials or fabric requiring stronger or larger size snaps; various snap combination units, various button, zipper and/or velcro securing means and other types of two-part attachment or coupling means or one-part and/or one-part, subunited means.

However, in the present invention it has been found that the use of corresponding snap means has been the most effective in securing the self supporting curtain and valance assembly 10, and is set forth herein in the preferred embodiment of the invention as the preferred coupling means where such means are referenced. Additionally, such coupling means members 30 can be setup, positioned and secured in close groupings of two or more members for selected emphasis in attachment and support.

The assembly 10 is further provided with a plurality of second snap-coupling members 32. Each of these members 32 is attached to the inside surface 26 of the flap portion 22 along a second common plane 23 which is correspondingly spaced and parallel positionally to the first coupling members 30 and the first common plane 22', so that the flap can be evenly looped and secured to itself around a curtain rod 12 and attached in a self-supporting arrangement, as illustrated in FIGS. 4 through 7.

As illustrated in FIGS. 4 through 7, the flap portion 22 is looped around the curtain or drapery rod 12 and brought together with itself so that the two common plane portions 22' and 23 are secured together around the rod 12 by the snap-coupling members 30 and 32 to hold and self-support the curtain 20 on the rod 12. In so doing, the inside surface areas 26 of the flap portion 22 of the curtain 20 are enclosed to form a continuous loop 34, or elliptical or flat elipse configuration, as the loop 34 is straightened out in pulling the curtain 20 down on the rod 12, or straightening both the flap and bottom portions 22 and 24 to make a more orderly appearance of the (fabric constructed) self-supporting curtain 20.

Figure 3:
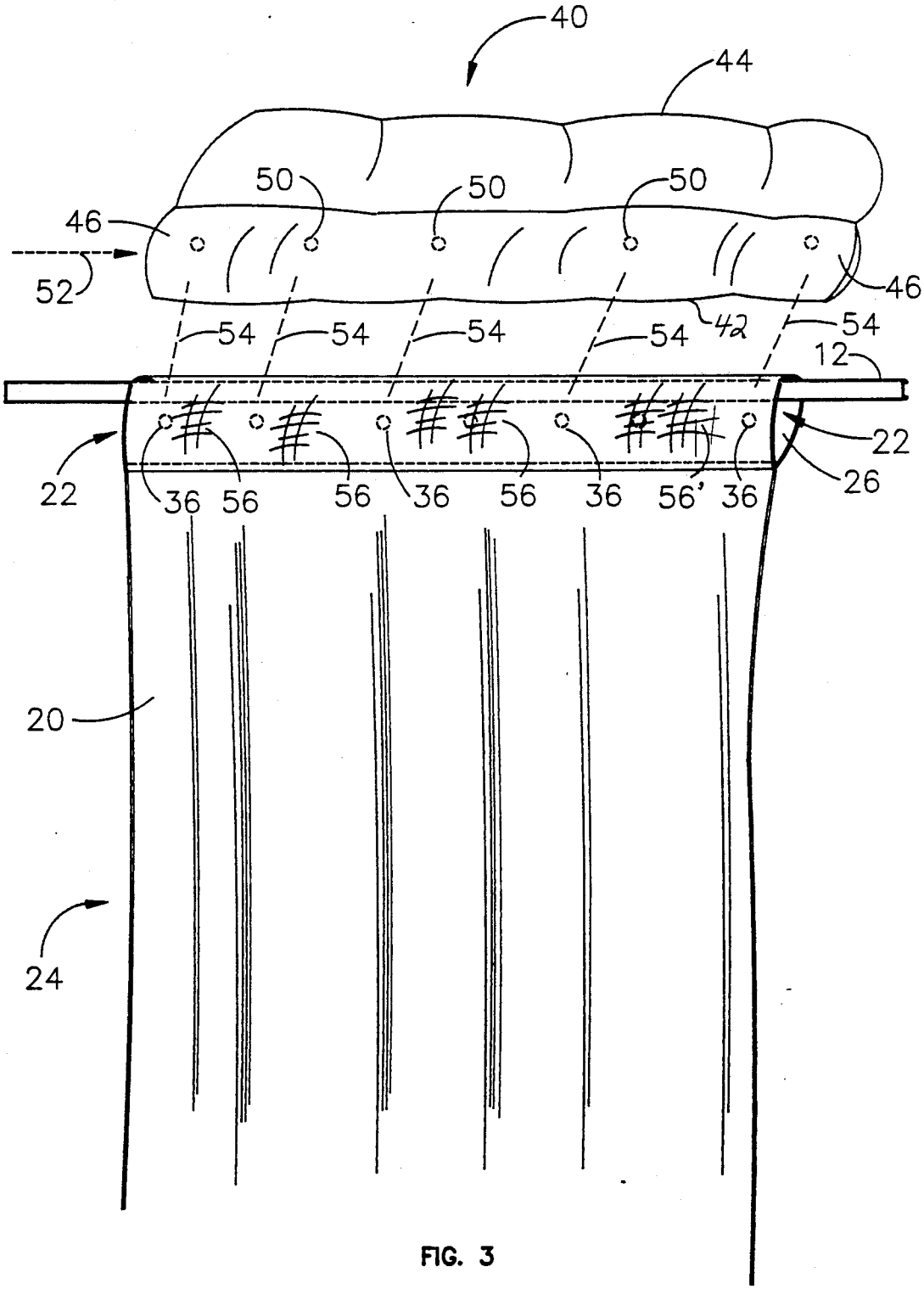
FIG. 3 is a perspective view of the invention illustrating positioning and attachment of the valance subassembly of the present invention with the curtain subassembly of the invention.

The curtain assembly 20 is provided with a group or plurality of third snap-coupling members 36, as illustrated in FIGS. 1A, 1B and 3. The third coupling members 36 are securely attached to the outside surface area 28 of the flap portion 22 on the curtain 20 along the third common plane portion 38. This third common plane portion 38 is parallel to the first and second common planes 22' and 23 and, on the outside surface 28 of the flap 22, is positioned so as to be spaced a small distance from what would be an equidistant point on the inside surface 26 between the first and second common plane portions 22' and 23. In so positioning the third common plance 38 and the secured third coupling members 36 on the outside surface area 28 of the flap 22, the third coupling members 36 come to be placed and secured in a position facing away from an installation area 18 where the curtain rod 12 is installed when the flap 22 is looped around the rod 12 and in self-supporting position, as illustrated by example in FIGS. 1A, 1B , 3 and 7 of the drawings.

The assembly 10 is also provided with the valance subassembly 40, as illustrated in FIGS. 1A, 1B , 2 and 3. The valance 40 is a shorter drapery portion, illustrated in configuration by example in FIG. 3, which, when positioned on the curtain subassembly 20 extends across the top or higher portion of the installation area 18.

The valance subassembly has generally designated top and bottom sections, 42 and 44, respectively; and inside and outside surface areas, 46 and 48, respectively. The valance 40 is illustrated by example in FIGS. 2 and 3 as having substantially equal or equivalent transverse dimensions in relation to the curtain subassembly 20, as shown in FIG. 3. However, it will be understood and appreciated that various dimensions, both transverse and otherwise, can be utilized in the present invention in designing specific dimensions for the valance 40 based on the desired effect, design, pattern or appearance desired, or curtain style, pattern or configuration utilized. Different shapes and sizes of valance subassemblies 40 are illustrated by example in FIGS. 2 and 3.

Additionally, it is illustrated in the drawings that one or more valance subassemblies 40 can be utilized in combination with one or more curtain subassemblies 20 on one curtain or drapery rod 12, as will be set forth in further detail later herein.

The valance 40 is provided with a group or plurality of fourth snap-coupling members 50 which are securely or fixedly attached to the inside surface area 46 on the top section 42 of the valance 40 along a fourth common plane portion 52 which is positioned so as to be substantially parallel when transversely aligned and corresponded to the third coupling members 36 and third common plane portion 38 on the curtain 20.

The valance subassembly 40 is then aligned with the curtain subassembly 20, as illustrated in FIG. 3 generally by positional phantom lines 54, so that each of the coupling members 36 and 50 are correspondingly aligned with each other so that each can be attached in combination to its appropriate subunit(s) forming part, in a preferred embodiment, of a two-part snap combination coupling unit. Each of the corresponding members 36 and 50 are then attached to one another as illustrated, so that the curtain 20 secures and supports the valance subassembly 40 in installed position without the need for additional hooks or drapery rods. In its supported position the outside surface area 48 of the valance 40 is supported by the valance 20 so that this outside surface 48 faces out away from an installation area 18. As illustrated by example in FIGS. 1A, 1B , 2 and 3, the valance 40 is shown in its final mounted position as being substantially parallel to the flap 22 and the transverse curtain rod 12. However, it is included within the concepts of the invention that the valance 40, by virtue of its particularly selected design configuration, may not be completely or substantially parallel to the flap 22 and the rod 12, and the coupling members 36 and 50 may be differently positioned to create different design effects.

By utilization of the present self-supporting assembly, the curtain subassembly and valance subassembly can both be supported and installed on one curtain rod 12, without the need for separate, independent attachable hooks and the like, or additional rods.

Additionally, in a preferred embodiment of the invention, the assembly 10 is provided with a porous mesh surface trim member 56, as illustrated in FIGS. 1A, 1B , 3, 4A and 7. The mesh surface is, as its name implies, provided with a number or plurality of open spaces 56', or pores, throughout the surface 56. The mesh surface 56 extends the transverse length of a part of the outside surface 28 of the flap 22, and extends over and covers the third common plane portion 38 and the third snap coupling members 36 on the flap 22, facing away from the installation area 18 when the curtain 20 is installed in self-supporting position. The placement of the mesh surface 56 is also illustrated positionally in an example of a flat, layout pattern in FIG. 4A of the drawings. The mesh surface 56 can be constructed from any of a number of flexibly porous or netted fabric materials, such as nylon netting materials, or any of a number of flexibly porous, materials.

In a preferred embodiment where the mesh surface trim member 56 is utilized as indicated in the present invention, the mesh surface 56 is securely attached along the transverse length of the outside surface 28 of the flap 22 as indicated and illustrated so that the mesh 56 extends over and covers the third common plane portion and the secured third snap coupling members 36 on the flap 22. When the flap 22 is looped around the curtain rod 12, so that it may be engaged for self-support, the mesh 56 faces outwardly away from the installation area 18 and the valance subassembly 40 can be coupled or snapably attached to the curtain subassembly 20 by connecting and attaching each of the third snap coupling members 36 of the curtain 20 and each of the corresponding fourth snap coupling members 50 of the valance through the flexibly positionable open spaces 56' or mesh pores of the mesh surface 56. When it is desired not to employ the use of the valance subassembly 40 in its installed position on the curtain 20, the mesh surface trim member can function in a trim or decorative capacity in covering the third snap coupling members 36 and areas therearound from direct visual appearance.

Figure 8:
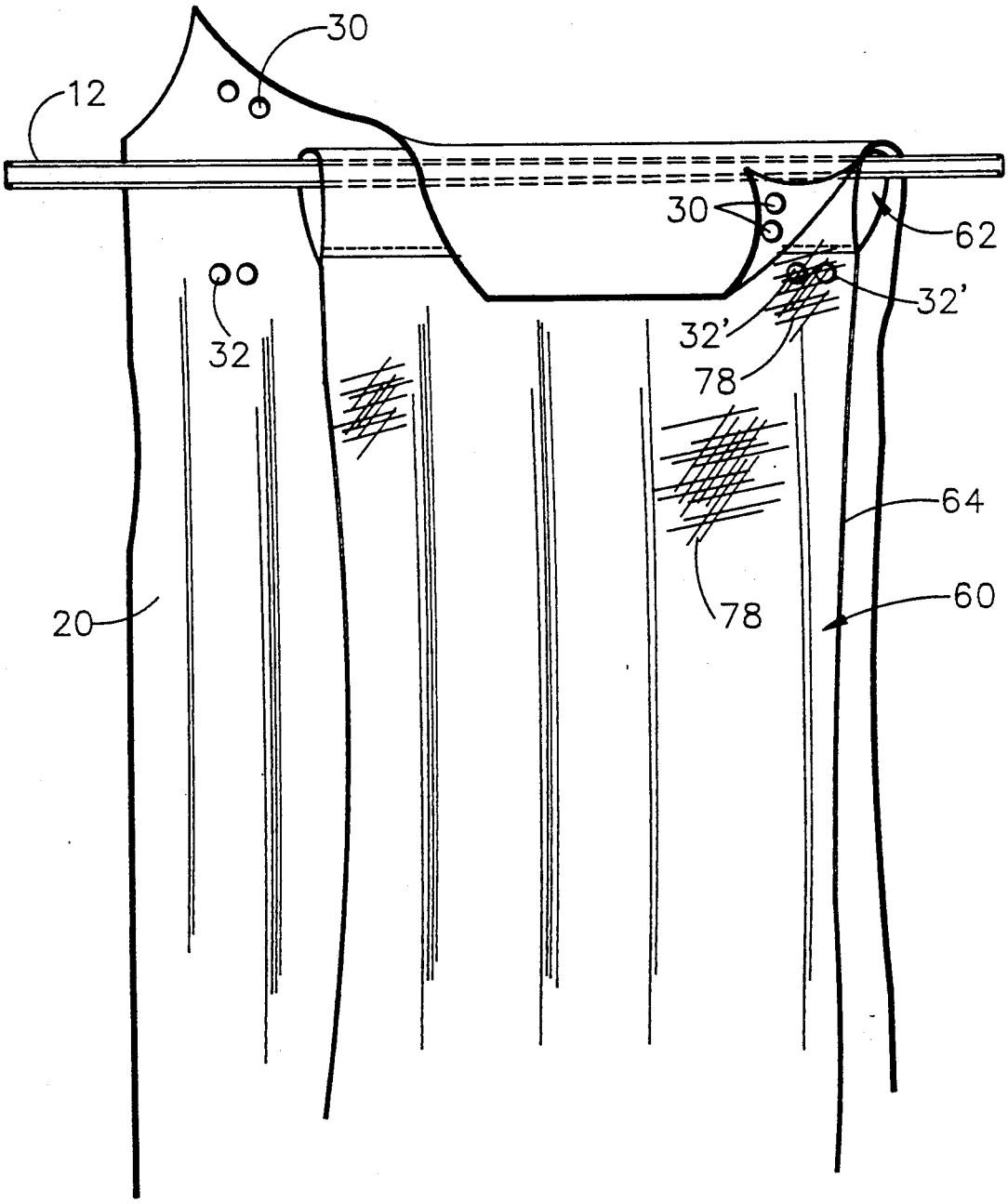
FIG. 8 is a back perspective view illustrating by example another preferred embodiment of the present invention including the curtain subassembly and the shear subassembly.
Figure 9:
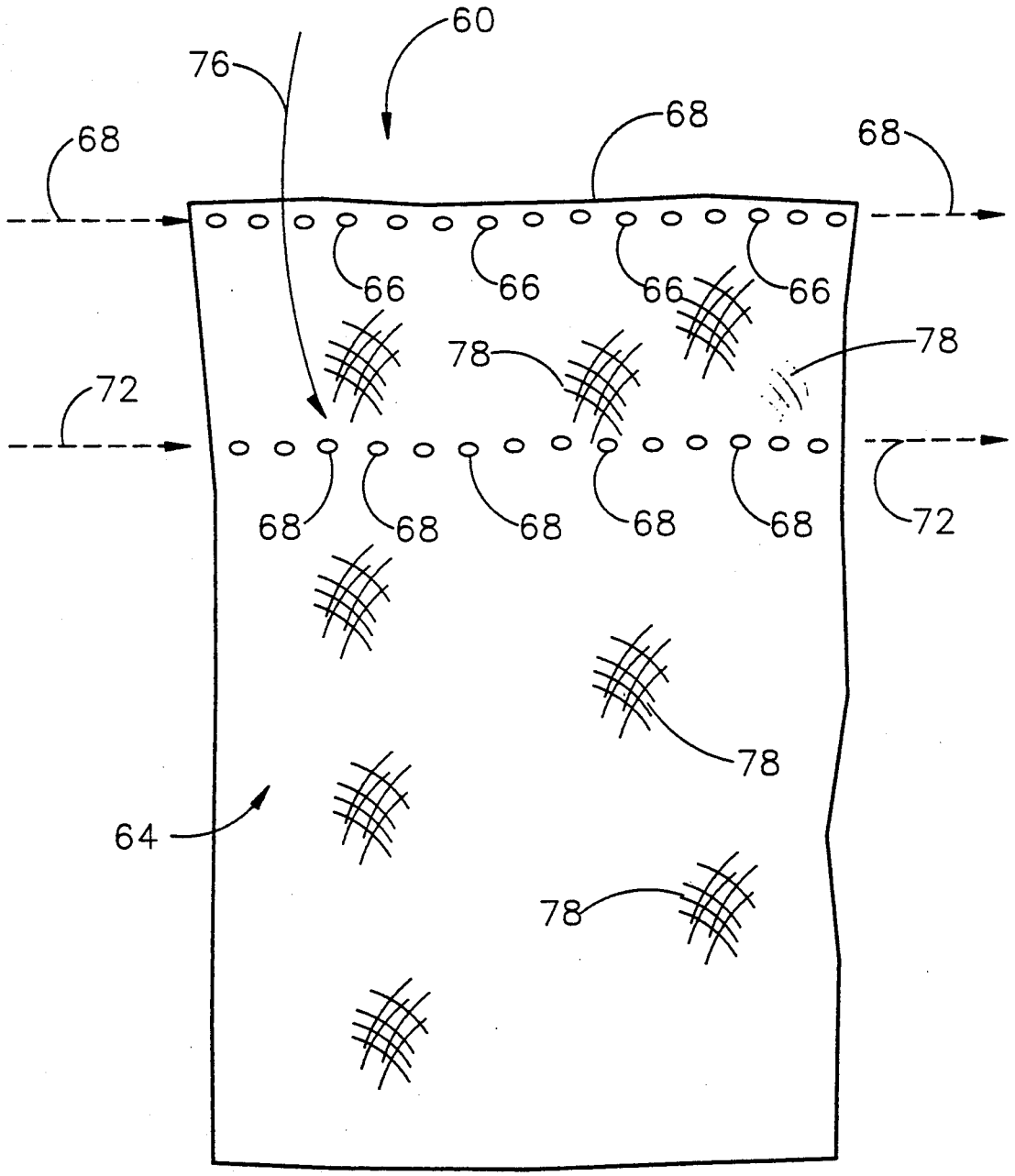
FIG. 9 is a substantially flat layout pattern view of the inside surface of the shear subassembly of the present invention.

The assembly 10 in another preferred embodiment of the invention can be provided with a shear subassembly 60, as illustrated in FIGS. 8 and 9. The shear 60 is shown by example to have a rectangularly shaped configuration similar to the curtain subassembly 20. The shear 60 can also be provided in other configurations, similar or non-similar, related or unrelated in shape, to the curtain 20. The shear 60 can be provided with a constructed, prefabricated or attachable looped flap section 62 as illustrated in FIG. 8, and a flexible, flat tail section 64.

In accordance with the concepts of the invention, set forth with respect to the curtain subassembly 20, the shear subassembly 60 is also provided, as illustrated in FIG. 9, with a group or plurality of first snap-coupling subunits 66. These snap subunits 66 are securely attached, by any of a number of threaded or other means (as is the case for all of the coupling member and means set forth herein), close to the top edge 68 of the shear 60 opposite the tail section 64, as illustrated in FIG. 9 in flat layout design, along a first straight common axis 70 on the shear 60. The second snap coupling subunits 72 are secured along another, second straight common axis 74 on the shear 60 which is spaced a selected distance from the first axis 70 to facilatate the top edge 68 being drawn and looped toward the second axis 74 around the rod 12, so that the first snap subunits 66 can be attached to the second snap subunits 72 by a looping motion, as indicated generally at 76 in FIG. 9. In this manner, the shear 60 can be installed on a single curtain rod 12 along with the curtain subassembly 20, and each of the subassemblies 20 and 60 will be self-supporting, and aid in supporting each other.

It will be understood that the concepts of the invention, and assembly 10, as set out with regard to the curtain subassembly 20, the valance subassembly 40 and the shear subassembly 60; include various combinations of male and female snap subunits, or other types of coupling units, to make up each of the respective coupling means and coupling combinations referenced in the specification.

The shear subassembly is constructed in one preferred embodiment of the invention from a porous or mesh fabric, material or substance which contains a plurality of open spaces 78 or mesh pores throughout its length and surfaces, as illustrated generally in FIG. 9. This mesh, open spaced or porous construction permits various subunits of coupling combination units to attach to one another through the cross-section or width of the shear subassembly 60.

Accordingly, the looped flap section 62, as illustrated in FIG. 8, or the edge 68 or first snap subunits 66, as illustrated in FIG. 9, can be looped, installed and/or securably engaged over a single transverse curtain rod 12 for self-supporting thereon. The curtain subassembly 20 can then be loopably engaged or looped over both the curtain rod 12 and the installed shear subassembly 60. Each of the first snap-coupling members 30 of the curtain 20 is then attached to each corresponding member of the second snap-coupling members 32 through respective, flexibly available open spaces 78 of the shear 60. In so doing, the flap 22 of the curtain is installed in closed and attached position over both the rod 12 and the shear 60. The shear 60 is, thereby, further supported by both the curtain 20 and the rod 12. This concept of the invention is illustrated in FIG. 8, showing the second snap-coupling members 32' available for connection and attachment through the open mesh spaces 78 of the shear 60 to the right of the drawing and the normally positioned snap member 32, behind the shear 60, to the left of the drawing.

It is also an important concept of the present invention, and utilization of the assembly, that the assembly 10 is provided as a one-piece setup, as illustrated by example generally at 80 in FIG. 2; or as a two part setup, as illustrated by example generally at 82 in FIG. 2. The two part arrangement of the assembly 10 utilizes a curtain assembly 20', as set forth in the specification for the curtain 20, on the left of the examplar-window installation area 18 illustrated in FIG. 2 to the left portion of the drawing; and an additional curtain subassembly 20" on the right side of the window illustrated in the same drawing. The valance subassembly 40 is illustrated in FIG. 2 as extending entirely across the covered transverse installation area 18, parallel and proximate to the curtain rod 12, and attaching as previously discussed herein by snap combination means 36 and 50 to the curtain subassemblies 20' and 20" at appropriate selected points on each curtain subassembly.

In utilizing the curtain assembly 20 as a two part arrangement 20' and 20", each respective assembly can be drawn back as illustrated in FIG. 2, or closed to partially or completely cover the window, installation area 18. Additionally, each of two valance subassemblies 40 can be utilized with each respective curtain 20 being used to cover an installation area 18. It will be understood that the concepts of the present invention include various combinations and employment of one or more curtain, valance and shear subassemblies on one or more curtain and drapery rods 12 to create different trim and design effects. The critical advantage of the present invention, however, is that all such trim and design effects can be accomplished utilizing a single curtain and drapery rod 12 in simple installed position.

It is also a preferred embodiment of the present invention, as illustrated in FIGS. 1 through 10, to employ the concept of utilizing the self installing and supporting curtain and valance assembly 10 in combination with a conventional shower curtain rod and the like, such that the assembly 10 can be installed to cover and service the entrance or immediate area juxtaposed to and from a shower, bath, shower-bath, spa, pool or water-related, or non-water related, workout area, sauna or rest area.

In this regard, therefore, it will be understood, that the curtain and drapery rod 12 can be any of a number of various types of shower curtain or shower-bath curtain support means (having different configurations), or other types of curtain or shower curtain support rods; and that these rods can be utilized in combination with the invention assembly 10 in all of the ways described in this specification for the use of the assembly 10 with, and in combination with, the curtain and drapery rod 12, and for all of the purposes and objects of the invention set forth herein, as they would reasonably relate to a shower, bath, spa, pool or other previously described or other workout or sports area.

Figure 10:
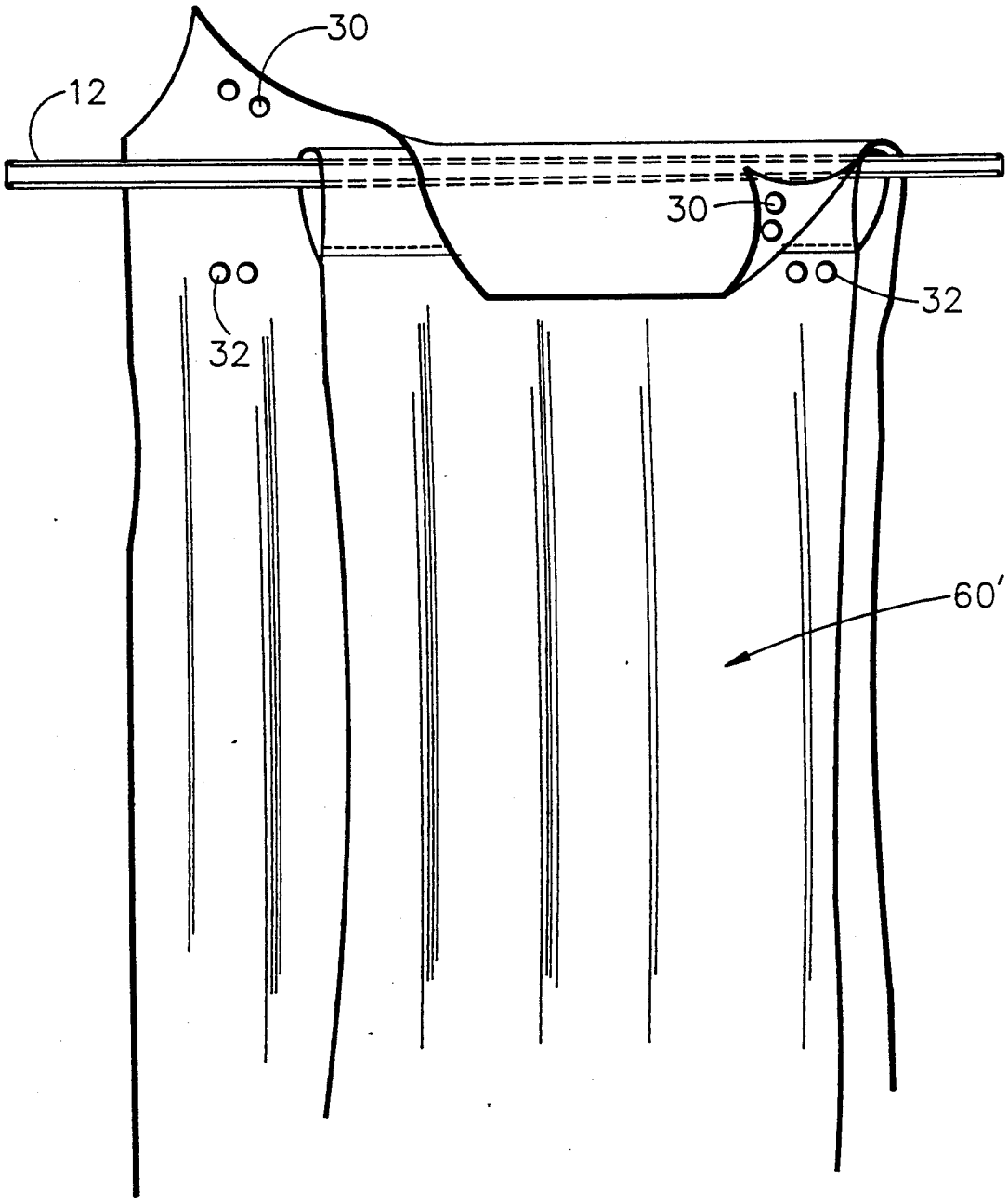
FIG. 10 is a back perspective view of another preferred embodiment of the present invention including the curtain and shear subassemblies.

Additionally, the concepts of the present invention also include the utilization of shear subassembly 60, as illustrated generally in FIG. 10, constructed from any of a number of soft, flexible fabric materials or other substances which, in and of themselves, can be mesh, non-mesh, porous or nonporous.

By constructing the shear 60 from such soft, flexible or tractable, or malleable, materials or substances, it is thereby possible to attach or connect the first and second snap-coupling members 30 and 32 of the curtain flap 22 to each other by pressing or bringing them together through the soft, flexible material of the shear 60', which is pliable and patterned by its structure characteristics to fit snugly between (and moldably about) the snap-coupling members 30 and 32 without interfering with their securing and supporting functions, as manifested by their connection to one another.

While the present invention has been described in connection with the particular embodiments thereof, it will be understood that many changes and modifications of this invention may be made by those skilled in the art without departing from the true spirit, concepts and scope thereof. For example, as indicated, other diversified types and kinds of materials may be used for each of the subassemblies 20, 40, and 60, and each of the coupling means or member-subunits; 30, 32, 36, 50, 66 and 72; and the mesh surface trim member 56; such as molded or flexible polymer, rubber, metal or alloy/-combination materials and substances.

Accordingly, the appended claims are intended to cover all such changes and modifications as falling within the true spirit and scope of the present invention. The reader is requested to determine the scope of the invention by the appended claims and their legal equivalents, and not by the examples which have been given.

Having described my invention, I claim:

1. A self-supporting curtain and valance assembly for direct mounting onto a conventional, transverse curtain or drapery rod installed at an installation area over a window, door or the like, and having front and back portions, the front portion of a curtain rod so installed facing away from an installation area and the back portion of a curtain rod facing toward an installation area, said curtain and valance assembly comprising:

a curtain subassembly having flap and bottom end portions and inside and outside surfaces, said curtain subassembly comprising:

a first coupling means attached to the inside surface of said flap end of said curtain along a first common plane portion, a second coupling means attached to the inside surface of said flap end along a second common plate portion spaced from said first common plate portion and parallel thereto, wherein said flap can be loopably engaged around a transverse curtain rod and the first coupling means can be attached to the second coupling means bringing the two inside common plane portions together for loopably self-supporting the curtain on a curtain rod, and a third coupling means attached to the outside surface of said flap along a third common plane portion parallel to said first and second common plane portions and facing in a direction away from an installation area where a curtain rod is installed when said flap is loopably engaged around a curtain rod;

a valance subassembly having top and bottom sections and inside and outside surfaces, said top section being substantially equivalent in transverse dimensions to the flap end portion of said curtain subassembly, said valance comprising a fourth coupling means attached to the inside surface of said top section along a fourth common plane portion, whereby the fourth coupling means can be attached to the third coupling means such that the valance is attachably supported by the curtain substantially parallel to an installed transverse curtain rod, and the outside surface of said valance faces away from an installation area, each of said coupling means being a reciprocal component of a two part snap combination means, said first and second coupling means means being a first snap combination means, and said third and fourth coupling means being a second snap combination means;

a porous surface member having a plurality of pores therein, and having transverse substantially equivalent to the flap end portion of said curtain, said porous surface being fixedly attached to a transverse portion of the outside surface of said flap such that when the flap is loopably engaged around a curtain rod the porous surface faces away from an installation area, said porous surface covering said third coupling means and allowing said third and fourth coupling means to attach to one another through the pores of said surface element when said valance is supportably attached to said curtain; and a shear subassembly, said shear having flap and bottom sections and inside and outside surfaces, said flap having a top transverse end, said subassembly comprising:

a first snap-coupling means attached to the inside surface of said flap section along a first common axis, proximate to the top transverse end of said flap; and a second snap-coupling means attached to the inside surface of said flap along a second common axis, spaced from and parallel to the first common axis, whereby the flap section of said shear can be loopably engaged around a transverse curtain rod for self-support thereon, and the flap end portion of said curtain can be loopably engaged around a same curtain rod and said shear installed thereon, and attached to itself for self-support by said first and second coupling means of the curtain which attach to one another through the shear constructed of said flexibly tractable substance, such that the surfaces of the shear pressed between the coupling means are molded to fit securely therein, between said means, without interfering with the attachment of said coupling means and the support of said curtain and said shear;

said curtain subassembly being constructed from material selected from a group consisting of antique satin, 70 percent polyester/30 percent cotton, 100 percent polyester, 70 percent polyester/27 percent to 30 percent rayon/1 percent to 3 percent cotton and 35 percent rayon/60 percent coloray acetate with rubber or cotton backing, other polyester, cotton, satin, rayon and coloray acetate combinations, other flexible fabric material and other flexible fabric material and other flexible, pliant substances.

2. The assembly of claim 1, wherein:

said shear subassembly defining a plurality of flexible pores communicating between said surfaces, whereby the flap section of said shear can be loopably engaged over a transverse curtain rod to support said shear thereon, and the flap end portion of said curtain can be loopably engaged around a same curtain rod and said shear installed thereon, and attached to itself for self support by said first and second coupling means of the curtain which attach to one another through the pores of said shear, such that said shear is supported by both the curtain and a curtain rod on which the curtain and the shear are installed.

3. In combination with a curtain or drapery rod having a transverse length with first and second ends, and front and back portions, being installed over a window or the like; an integrally self-supporting curtain and valance assembly comprising:

a curtain subassembly having flap and bottom end portions and inside and outside surfaces, said curtain subassembly comprising:

a first coupling means attached to the inside surface of said flap end of said curtain along a first common plane portion, a second coupling means attached to the inside surface of said flap end along a second common plate portion spaced from said first common plate portion and parallel thereto, whereby said flap is loopably engaged around the curtain rod, and the first coupling means is releasably attached to the second coupling means, bringing the first and second common plane portions together such that the flap loopably mounts and self-supports the curtain subassembly on the curtain rod, and a third coupling means, said third means being fixedly attached to the outside surface of the flap portion, along a third common plane portion parallel to the first and second common plane portions and facing in a direction away from a window installation area where the curtain rod is installed when the flap is loopably engaged and mountably positioned, said curtain subassembly being constructed from material selected from a group consisting of satin, polyester/cotton, polyester, polyester/rayon/cotton, rayon/coloray acetate with rubber or cotton backing, other polyester, cotton, satin, rayon and coloray acetate combinations, other flexible fabric material and other flexible, pliant substances, a valance subassembly having top and bottom sections and inside and outside surfaces, said top section being substantially equivalent in transverse dimensions to the flap end portion of said curtain subassembly, said valance subassembly comprising a fourth coupling means, said fourth means being fixedly attached to the inside surface of said top section along a fourth common plane portion, such that the fourth coupling means can be brought into attachable allignment with said third coupling means, whereby the fourth coupling means is releasably attached to the third coupling means such that the valance subassembly is mountably supported by the curtain subassembly, substantially parallel to the transverse length of said curtain rod, and the outside surface of said valance faces in a direction away from an installation area at which said curtain rod is installed, each of said first, second, third and fourth coupling means being a reciprocal component of a two part, male-female or female-male snap combination means, said first and second coupling means being a first snap combination means, and said third and fourth coupling means being a second snap combination means, a porous surface member having a plurality of pores therein, and having transverse dimensions substantially equivalent to the flap end portion of said curtain, said porous surface being fixedly attached to a transverse portion of the outside surface of said flap such that when the flap is loopably engaged around a curtain rod the porous surface faces away from an installation area, said porous surface covering said third coupling means and allowing said third and fourth coupling means to attach to one another through the pores of said surface element when said valance is supportably attached to said curtain; and a shear subassembly having flap and bottom sections and inside and outside surfaces, said flap having a top transverse end, said subassembly comprising:

a first snap-coupling means attached to the inside surface of said flap section along a first common axis, proximate to the top transverse end of said flap; and a second snap-coupling means attached to the inside surface of said flap end along a second common axis, spaced from and parallel to the first common axis, whereby said flap section of said shear can be loopably engaged around a transverse curtain rod installed over an installation space, and the first snap-coupling means can be attached to the second snap coupling means, thereby bringing the inside surface of the flap section together to form a self-supporting loop around a curtain rod for support thereof, said flap and bottom sections of said shear being constructed from a soft, flexibly tractable substance, whereby the flap section of said shear can be loopably engaged around a transverse curtain rod for self-support thereon, and the flap end portion of said curtain can be loopably engaged around a same curtain rod and said shear installed thereon, and attached to itself for self-support by said first and second coupling means of the curtain which attach to one another through the shear constructed of said flexibly tractable substance, such that the surfaces of the shear pressed between the coupling means are molded to fit securely therein, between said means, without interfering with the attachment of said coupling means and the support of said curtain and said shear.

4. The combination of claim 3, wherein:

said flexibly tractable substance is a porous material having flexible pores, and said shear is positioned such that said first and second coupling means of said curtain are coupable to one another through the pores of said shear to support and position the shear in relation to and by the curtain for self support thereof, whether or not the first and second snap-coupling means of said shear are fixably employed for self support, thereby allowing back-up self-support thereof.

5. In a combination with a shower-bath curtain support means having top and bottom ends and front and back portions, being installed in an installation area in juxtaposition to a shower-bath area;

an integrally self-supporting curtain and valance assembly comprising:

a curtain subassembly having flap and bottom end portions, and inside and outside surfaces, said curtain subassembly comprising:

a first coupling means attached to the inside surface of said flap end of the curtain along a first common plane portion, a second coupling means attached to the inside surface of said flap end along a second common plane portion spaced from said first common plane portion and parallel thereto, whereby said flap is loopably engaged around the shower-bath curtain support means, and the first coupling means is releasably attached to the second coupling means, bringing the first and second common plane portions together such that the flap loopably mounts and self-supports the curtain subassembly on the shower-bath support means, and a third coupling means, said third means being fixedly attached to the outside surface of the flap portion, along a third common plane portion parallel to the first and second common plane portions and facing in a direction away from a shower-bath area where the shower-bath support means is installed when the flap is loopably engaged and mountably positioned, a valance subassembly having top and bottom sections, and inside and outside surfaces, said top section being substantially equivalent in dimensions of length, to the flap end portion of said curtain subassembly, said valance assembly comprising a fourth coupling means, said fourth means being fixedly attached to the inside surface of said top section along a fourth common plane portion, such that the fourth coupling means can be brought into attachable allignment with said third coupling means, whereby the fourth coupling means is releasably attached to the third coupling means such that the valance subassembly is mountably supported by the curtain subassembly, substantially parallel to the top end of said curtain rod, and the outside surface of said valance faces in a direction away from a shower-bath area at which said shower-bath curtain support means is installed, each of said first, second, third and fourth coupling means being a reciprocal component of a two part, male-female or female-male snap combination means, said first and second coupling means being a first snap combination means, and said third and fourth coupling means being a second snap combination means, a porous surface member having a plurality of flexible pores therein, and having transverse dimensions substantially equivalent to the flap end portion of said curtain, said porous surface being fixedly attached to a transverse portion of the outside surface of said flap such that when the flap is loopably engaged around the curtain support means the porous surface faces away from a shower-bath area, said porous surface covering said third coupling means and allowing said third and fourth coupling means to attach to one another through and moldably a part of the flexible pores of said surface element when said valance is supportably attached to said curtain subassembly, and a shear subassembly, said shear having flap and bottom sections and inside and outside surfaces, said flap having a top transverse end, said subassembly comprising:

a first snap-coupling means attached to the inside surface of said flap section along a first common axis, proximate to the top transverse end of said flap; and a second snap-coupling means attached to the inside surface of said flap end along a second common axis, spaced from and substantially parallel to the first common axis, whereby said flap section of said shear can be loopably engaged around the curtain support means installed over a shower-bath area, and the first snap-coupling means can be attached to the second snap-coupling means, thereby bringing the inside surface of the flap section together to form a self-supporting loop around the curtain support means for support thereof;

said flap and bottom sections of said shear being constructed from a soft, flexibly tractable material, whereby the flap section of said shear can be loopably engaged around the curtain support means for self-support thereon, and the flap end portion of said curtain can be loopably engaged around the curtain support and the shear installed thereon, and attached to itself for self-support by said first and second coupling means of the curtain which attach to one another through the shear such that the surfaces of the shear pressed between the coupling means are molded to fit securely therein, between said coupling means, without interfering with the attachment of said coupling means and the support of said curtain and said shear.

6. The combination of claim 5, wherein:

said flexibly tractable material is a porous material having flexible pores, and said shear is positioned such that said first and second coupling means of said curtain are coupable to one another through the pores of said shear, to support and position the shear in relation to and by the curtain for self support thereof, whether or not the first and second snap-coupling means of said shear are fixably employed for self support, thereby allowing back-up, self-support thereof.

* * * * *